US008353511B2

(12) United States Patent
Tozaki

(10) Patent No.: US 8,353,511 B2
(45) Date of Patent: Jan. 15, 2013

(54) PAPER DISCHARGE DEVICE

(75) Inventor: Shuji Tozaki, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/931,990

(22) Filed: Feb. 15, 2011

(65) Prior Publication Data

US 2011/0198802 A1 Aug. 18, 2011

(30) Foreign Application Priority Data

Feb. 18, 2010 (JP) ..... 2010-033927

(51) Int. Cl.
*B65H 29/00* (2006.01)

(52) U.S. Cl. ..... 271/279; 271/902

(58) Field of Classification Search ..... 271/225, 271/902, 279, 289, 298; 235/379, 475; 902/36
See application file for complete search history.

(56) References Cited

U.S. PATENT DOCUMENTS 4,784,274 A * 11/1988 Mori et al. ..... 209/534
5,258,045 A * 11/1993 Yamashita ..... 271/225
6,073,837 A * 6/2000 Milne ..... 235/379
6,386,445 B2 * 5/2002 Imai et al. ..... 235/379
6,428,226 B1 * 8/2002 Suzuki et al. ..... 400/642
7,669,845 B2 * 3/2010 Graef et al. ..... 235/379
2002/0014526 A1 2/2002 Imai et al. ..... 233/379
2003/0007823 A1 1/2003 Tsuchiya et al. ..... 400/617
2004/0222296 A1 11/2004 Douglass et al. ..... 235/381

* cited by examiner

*Primary Examiner* — Jeremy R Severson
(74) *Attorney, Agent, or Firm* — Adams & Wilks

(57) ABSTRACT

A paper discharge device includes a waiting path, one side of which is connected to an input port and another side of which is connected to a discharge port. A collection path has one side connected to the waiting path through a merged portion and another side connected to a collection chamber. Conveyance mechanisms disposed along the waiting path convey a paper which was conveyed through the input port to the discharge port in a forward direction, and convey, after lapse of a given period of time after conveyance of the paper to the discharge port, the paper in a reverse direction through the merged portion to feed into the collection path. The waiting path has a downward curvature between the merged portion and the discharge port.

11 Claims, 10 Drawing Sheets

PAPER DISCHARGE DEVICE

BACKGROUND OF THE INVENTION

1. Field of the Invention

The present invention relates to a paper discharge device, which discharges received paper from a discharge port.

2. Description of the Related Art

At present, there exist many devices (apparatus), which are designed so as to automatically deliver to users various paper such as passes of toll roads, admission tickets of various facilities, or rail road tickets of various transportation, and statements of account, etc. issued from automated teller machines (ATM), cash dispensers (CD), or the like. In general, a paper discharge device is incorporated into those devices, which conveys the paper, after receiving the paper printed by a printer, or the like, to a discharge port, and discharges the printed paper from the discharge port.

The discharge devices of this type are so constructed, in many cases, as to cause the received paper to stay (wait) inside the devices until processings such as printing and cutting are ended, and as to convey the paper to the discharge port at the time of the processings are ended.

This is because, if the paper is discharged from the discharge port before the processings are not ended, there is a fear of causing degradation of printing quality or cutting failure due to the paper being pulled or pressed during the processings.

There is employed as a specific construction a construction in which the waiting path is formed so as to have a long length, and the received paper is caused to wait in the path until the processings are ended. In this case, it is preferred that the length of the waiting path is made longer as much as possible in order to deal with the paper having a long length. However, when the length of the waiting path becomes longer, the size of the entire device becomes larger. As a result, it becomes difficult to achieve the downsizing (more compacting). Accordingly, it is desired to make the waiting path longer while achieving the downsizing of the entire device.

By the way, there are many cases where personal information, confidential matters, or the like of the user may be printed on the paper to be delivered to the user. For example, on the statement of account issued from ATM, CD, or the like, there are printed a card number, a trade amount, the balance, and the like. Therefore, when handling this type of statement of account, employment of security countermeasures is required so as to keep the paper away from other person's eye.

As one of the security countermeasures, there is known a discharge device, which employs the countermeasure involving automatically collecting the statement of account when the discharged statement of account was not received by the user. Specifically, there is known a discharge device having a construction in which, after discharging the statement of account from the discharge port, when the statement of account was not received even if a given period of time has elapsed, the statement of account is reconveyed to a collection chamber, and thrown into the collection chamber.

As this type of discharge device, for example, there is known a paper discharge device as described in Japanese Patent Application Laid-open No. 2001-261228.

The paper discharge device includes: a first conveyance path connected to an input port; a second conveyance path, one side of which is merged into the first conveyance path, and another side of which is connected to the discharge port; a third conveyance path, one side of which is merged into the first conveyance path, and another side of which is connected to a paper stock space and a collection space; and conveyance mechanisms, such as driving rollers, for selectively feeding the paper conveyed through the first conveyance path into the second conveyance path or the third conveyance path, to thereby convey the paper to the discharge port, the paper stock space, or the collection space.

In the paper discharge device thus constructed, when the paper is input into the first conveyance path through the input port, the conveyance mechanism temporarily conveys the paper into the paper stock space through the third conveyance path. During this period, the paper is subjected to printing just before the input port. Specifically, the paper is adapted to wait and stay within the paper stock space until the printing is ended and the paper is cut.

Then, when the printing and cutting are ended, the conveyance mechanism feeds the paper into the second conveyance path while reversely conveying the paper in the third conveyance path. Then, the paper is conveyed through the second conveyance path to the discharge port. With this, the paper is discharged from the discharge port so that a part of the paper is projected outside.

Here, if a given period of time has elapsed as it is without the paper being received, the conveyance mechanism conveys the paper reversely in the second conveyance path so that the paper is withdrawn from the discharge port. Then, the conveyance mechanism conveys the paper again to the third conveyance path, and also feeds into the collection space while passing through the paper stock space. With this, the paper is collected within the collection space.

Like this, when the paper was not received by the user, it is constructed such that the paper is automatically collected into the collection chamber, and security countermeasures so as to keep the paper away from other person's eye are performed.

Moreover, the third conveyer path is a path communicated to a paper stock space, and functions as a waiting path for causing the paper to wait until the processings such as cutting are ended. In this case, the third conveyance path is curved, and is designed so as to contribute to a downsizing of an entire device although the third conveyance path is long.

However, in the above-mentioned conventional paper discharge device, there still remain the following problems.

In general, there are many cases where the paper used for the statement of account is originally roll paper wound around into roll shape. Specifically, after pulling out from the roll paper, the paper is used as the statement of account, etc. after subjecting the paper to a printing process and a cutting process. For that reason, the paper is inevitably liable to impart the rounding in the conveying direction (paper curling).

Therefore, the collected paper does not keep the level state within the collection space, and is liable to round due to the paper curling into a bulky state.

By the way, the third conveyance path is curved so as to direct toward the collection space, and hence the paper waiting within the paper stock space is hung down into the collection space. In this case, when the paper which has already been collected are bulky due to paper curling within the collection space, the paper in a waiting state is liable to be entangled with the collected paper, and there was a risk of causing paper jam.

SUMMARY OF THE INVENTION

The present invention has been made in view of the above-mentioned circumstances, and has an object to provide a paper discharge device, which is capable of securing a sufficient length of a waiting path while achieving downsizing of the entire device, and of allowing paper in a waiting state to wait without being brought into contact with the collected paper until the processings such as printing are ended.

The present invention provides the following measures in order to solve the above-mentioned object.

(1) According to the present invention, there is provided a paper discharge device, which conveys, after receiving paper under processing through an input port, the paper to a discharge port after the processing is ended, and also reconveys the paper which was not received by a user from the discharge port to a collection chamber to throw the paper not received into the collection chamber, the paper discharge device including:

a waiting path, one side of which is connected to the input port and another side of which is connected to the discharge port;

a collection path, one side of which is connected to the waiting path through a merged portion and another side of which is connected to the collection chamber; and a plurality of conveyance mechanisms provided along the waiting path, for conveying the paper which was conveyed through the input port until the discharge port in a forward direction, and for conveying, after lapse of a given period of time after the conveyance of the paper, the paper in a reverse direction through the merged portion to feed into the collection path, in which the waiting path is formed into a curve so that the interval between the merged portion and the discharge port is swelled downward.

In the paper discharge device according to the present invention, when the paper is fed into the waiting path through an input port, the paper stays within the waiting path and waits until the processing such as printing or cutting is ended without being discharged from the discharge port. Here, when the processing such as printing or cutting is ended, the conveyance mechanism conveys the paper waiting within the waiting path in the forward direction which is directed to the discharge port. With this, the paper is discharged from the discharge port, and becomes a state in which a part of the paper is projected outside. That is, the paper becomes a receive-waiting state of waiting to be received by a user.

Here, if a given period of time has elapsed without the discharged paper being received by the user, the conveyance mechanism reconveys the paper to a direction which is reverse to the former direction to cause the paper to forward toward the merged portion. Then, if the conveyance mechanism conveys the paper to the merged portion, the conveyance mechanism feeds the paper into the collection path. Then, the paper fed into the collection path is conveyed to a downstream side of the collection path to be thrown into the collection chamber. With this operation, the paper, which was not received by the user, may be collected to the collection chamber, thereby being capable of preventing the paper to be exposed to others.

In particular, as the waiting path is formed so as to be curved across the interval between the merged portion and the discharge port, the linear length from the merged portion to the discharge port may be shortened while securing a sufficient path length. Therefore, while achieving downsizing and more compact size of the entire device, it is possible to secure the sufficient length of the waiting path. Accordingly, even if the paper has a long print length, it is possible to cause the paper to wait reliably until the printing operation, or the like within the waiting path.

Further, the waiting path is formed into a curve so as to be swelled downward between the merged portion and the discharge port, and hence when the paper which was not received by the user is reconveyed from the discharge port toward the merged portion, the paper is conveyed such that the paper is once moved downward from the discharge port, and thereafter move upward as approaching to the merged portion. Then, the paper, which has been moved upward, is guided as it is to the collection path, and thereafter thrown into the collection chamber. Therefore, the paper may be thrown into the collection chamber as if the paper is fallen down from the above. Accordingly, the paper may be efficiently thrown into the collection chamber, thereby being capable of enhancing the collection efficiency.

In addition, the paper, which is guided to the waiting path through the input port, waits within the waiting path until the processings such as cutting are ended. However, at this point of time, the paper is hard to enter into the collection path. Specifically, different from conventional ones, the paper in a waiting state is allowed to wait without being brought into contact with the collected paper. Therefore, the paper in a waiting state is prevented from being entangled with the collected paper, thereby being capable of suppressing occurrence of paper jam, or the like.

(2) According to a paper discharge device of the present invention, in the above-mentioned paper discharge device of the invention, the plurality of conveyance mechanisms each include:

driving rollers which convey the paper in one of a forward direction and a reverse direction; and driven rollers which are driven in contact with the driving rollers, and are capable of sandwiching the paper between itself and the driving rollers.

In the paper discharge device according to the present invention, the conveyer mechanisms each include the driving rollers and the driven rollers capable of sandwiching the paper, and hence it is possible to reliably convey the paper along the waiting path by such an easy method involving suitably rotating the driving rollers.

In particular, as the paper is sandwiched, it is possible to convey the paper while stably holding the paper, thereby being capable of suppressing the occurrence of paper skew.

(3) According to a paper discharge device of the present invention, the above-mentioned paper discharge device of the invention, further including an urging member which urges the driven rollers toward the driving rollers side so that the both rollers are brought into pressure-contact with each other In the paper discharge device according to the present invention, the driven rollers are brought into pressure contact with the driving rollers by the urging member. As a result, it is possible to more reliably convey the paper while sandwiching therebetween (4) According to a paper discharge device of the present invention, the above-mentioned paper discharge device of the invention, further including:

a base plate for guiding the paper; and a cover plate which is overlapped with respect to the base plate with a gap, to thereby define a path between itself and the base plate, in which at least a part of the base plate is made separable with respect to the cover plate so that the waiting path is releasable.

In the paper discharge device according to the present invention, the waiting path is defined between the base plate and the cover plate, and hence while guiding the paper by the both plates, it is possible to convey the paper along the waiting path in the forward direction directing toward the discharge port, or in the reverse direction directing toward the merged portion. In particular, as the paper may be guided by the both plates, even if the waiting path itself is curved, it is possible to smoothly convey the paper.

Moreover, the at least the part of the base plate is spaced away from the cover plate to release the waiting path, even if the paper is caused to paper jam, or the like within the waiting path, it is possible to resolve the paper jam by immediately removing the paper, or the like.

(5) According to a paper discharge device of the present invention, in the above-mentioned paper discharge device of the invention, at the merged portion, a leading member for leading the paper, which was conveyed in the reverse direction in the waiting path, toward the collection path side, is formed.

In the paper discharge device according to the present invention, when the paper, which was not received by the user, is reconveyed in the reverse direction to guide the paper into the collection path, the leading member leads the paper into a correct direction, to thereby reliably guide the paper to the collection path. For that reason, it is possible to prevent the paper being guided at the merged portion wrongly toward the input port side. Accordingly, clogging of the paper, or the like may be prevented in advance.

According to the paper discharge device of the present invention, it is possible to secure the sufficient length of the waiting path while achieving downsizing of the entire device, and of allowing the paper in the waiting state to wait without being brought into contact with the collected paper until the processings such as printing are ended.

DETAILED DESCRIPTION OF THE INVENTION

Hereinafter, an embodiment of the present invention is described with reference to FIG. 1 to FIG. 10. Note that, in this embodiment, as illustrated in FIG. 1, description is made of a printer 1 by way of example, into which a print unit 2, and a paper discharge unit (paper discharge device) 3 are integrally incorporated.

Figure 1:
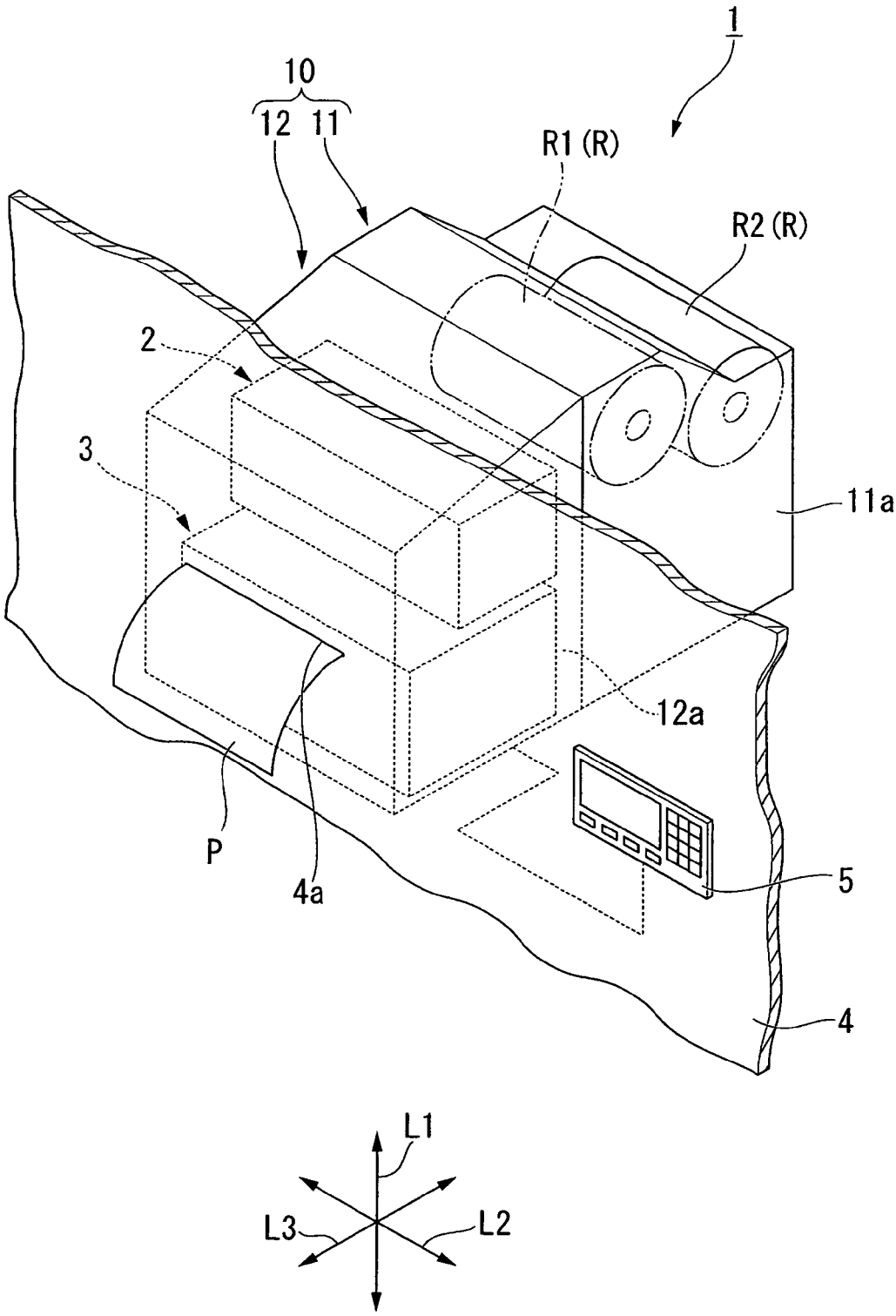
FIG. 1 is a view for illustrating an embodiment of the present invention, and is a perspective view schematically illustrating an overall outer appearance of a printer.

Note that, FIG. 1 is a perspective view schematically illustrating an overall outer appearance of the printer 1.

The printer 1 is usually used, for example, by being incorporated into an automated teller machine (ATM), a cash dispenser (CD), and the like, and is installed so as to be brought into contact with an inner side of an enclosure 4 of the ATM or CD. Then, a paper (statement of account, etc.) P, which is printed and discharged by the printer 1, is discharged through an eject port 4*a* formed in the enclosure 4 so as to be delivered to a user.

Note that, the printer 1 is configured to operate based on an instruction input by, for example, an operation panel 5 fixed to the enclosure 4.

Further, in this embodiment, directions which are orthogonal to each other along an in-plane direction of the enclosure 4 are defined as a vertical direction Ll and a transverse direction L2, and a direction which is orthogonal to those two directions is defined as a fore-and-aft direction L3. Further, along the fore-and-aft direction L3, the enclosure 4 side is defined as a front, and a side separating away from the enclosure 4 is defined as a rear.

Hereinafter, detailed description is made of the structure of the printer 1.

Figure 2:
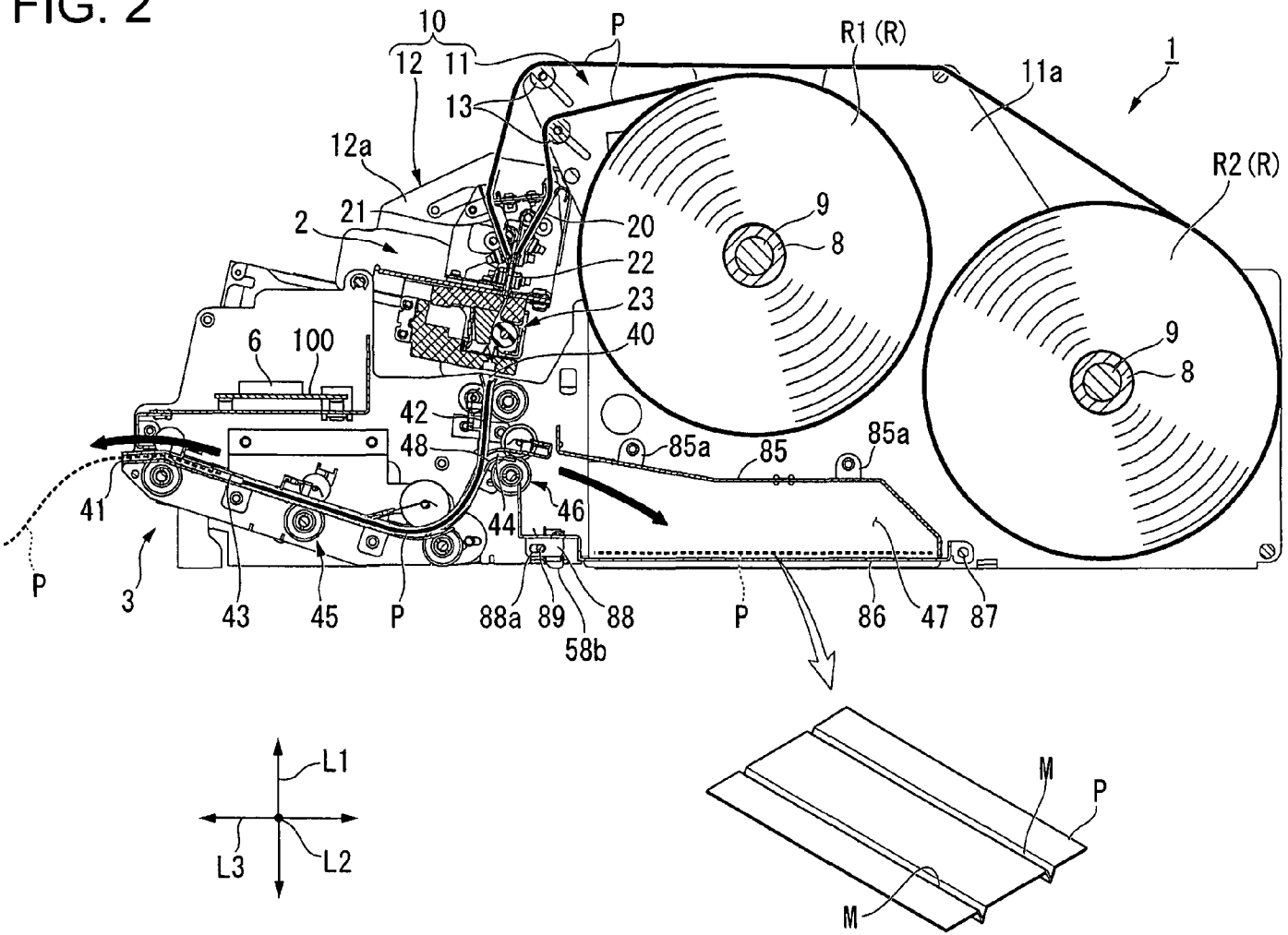
FIG. 2 is a sectional view of the printer illustrated in FIG. 1.

The printer 1 mainly includes, as illustrated in FIG. 2, the print unit 2, which performs printing with respect to a paper P and includes a cutter mechanism 24, which performs cutting of the paper P after being printed by a predetermined length; the paper discharge unit 3, which ejects the printed paper P through an eject port 4*a* of the enclosure 4; and a casing 10, which supports those two units 2 and 3.

Note that, FIG. 2 is a sectional view of the printer.

The casing 10 is formed of a plastic or a metallic material such as stainless, and includes: a first casing 11, which mainly axially-supports two roll papers R; and a second casing 12, which is connected to the front side of the first casing 11, and mainly supports the print unit 2 and the paper discharge unit 3.

The first casing 11 includes a pair of side surface panels 11*a*, which are aligned in the transverse direction L2 so as to oppose to each other while sandwiching the roll paper R therebetween. To those pair of side surface panels 11*a*, there are formed cut away grooves (not shown) for fitting thereinto the shaft portions 9 for axially supporting the roll papers R.

The roll papers R are formed by winding the paper P around a cylindrical core portion 8 into a roll form. One of the roll papers R is set as a main roll (hereinafter, referred to as R1), and another one of the roll papers R is set as a preliminary roll (hereinafter, referred to as R2). Through the core portion 8, the shaft portions 9 is inserted, and the roll papers R is set as being rotatable relative to the shaft portions 9. Then, as the shaft portions 9 are fitted into the cut away grooves of the side surface panels 11*a*, the roll papers R are supported to the first casing 11.

In this case, the two roll papers R are supported so as to align in the fore-and-aft direction L3, and also supported so that the rear-side roll paper R becomes lower in height than the forward-side roll paper R. Note that, the roll paper R positioned at the forward side is set as the main roll R1, and the roll paper R positioned at the rear side is set as the preliminary roll R2.

Further, after the papers P, which are wound around the two roll papers R, are pulled out toward the front side, and after the papers P are fed to the print unit 2 supported to the second casing 12, the papers P are in a print waiting state within a first guide path 20 and a second guide path 21 described later. Then, when printing is started, the paper P, which is pulled out from the main roll R1, among the papers P which are in the print waiting state, is fed to the downstream side to be subjected to printing process, and at the same time, is delivered to the paper discharge unit 3.

Then, until a printing operation and a cutting operation are ended, the paper P is caused to wait within a below-mentioned waiting path 43 of the paper discharge unit 3. After that, the printing operation and a cutting operation are ended, the paper P of the waiting state is fed to a discharge port 41, and is discharged through the eject port 4*a* of the enclosure 4 (refer to FIG. 1). After that, in a case where the paper P was not received by a user, the paper P is adapted to be reconveyed by the paper discharge unit 3 to be thrown into a collection chamber 47.

Specifically, the paper P pulled out from the main roll R1 is caused to wait within the waiting path 43 until the printing operation and the cutting operation are ended, and after the printing operation and a cutting operation are ended, the paper P is discharged through the eject port 4*a* of the enclosure 4. Then, in the case where the paper P was not received by the user, the paper P is adapted to be collected within the collection chamber 47.

At upper portions of the front side of the side surface panels 11*a* of the first casing 11, there are provided direction changing rollers 13 for changing a direction of each of the paper P pulled out from the main roll R1 and the preliminary roll R2 into downward to be directed to the print unit 2. The direction changing rollers 13 are urged upward so as to be able to apply a given tension by pushing up the paper P from down to up. With this, the paper P pulled out from the main roll R1 and the preliminary roll R2 are adapted to be fed to the print unit 2 under a state of being less likely to cause sagging.

The second casing 12 includes, similar to the first casing 11, a pair of side surface panels 12*a*, which are aligned in the transverse direction L2 so as to oppose to each other. Then, the print unit 2 is installed so as to be sandwiched between those pair of side surface panels 12*a*.

(Print Unit)

Next, description is made of the print unit 2.

Figure 3:
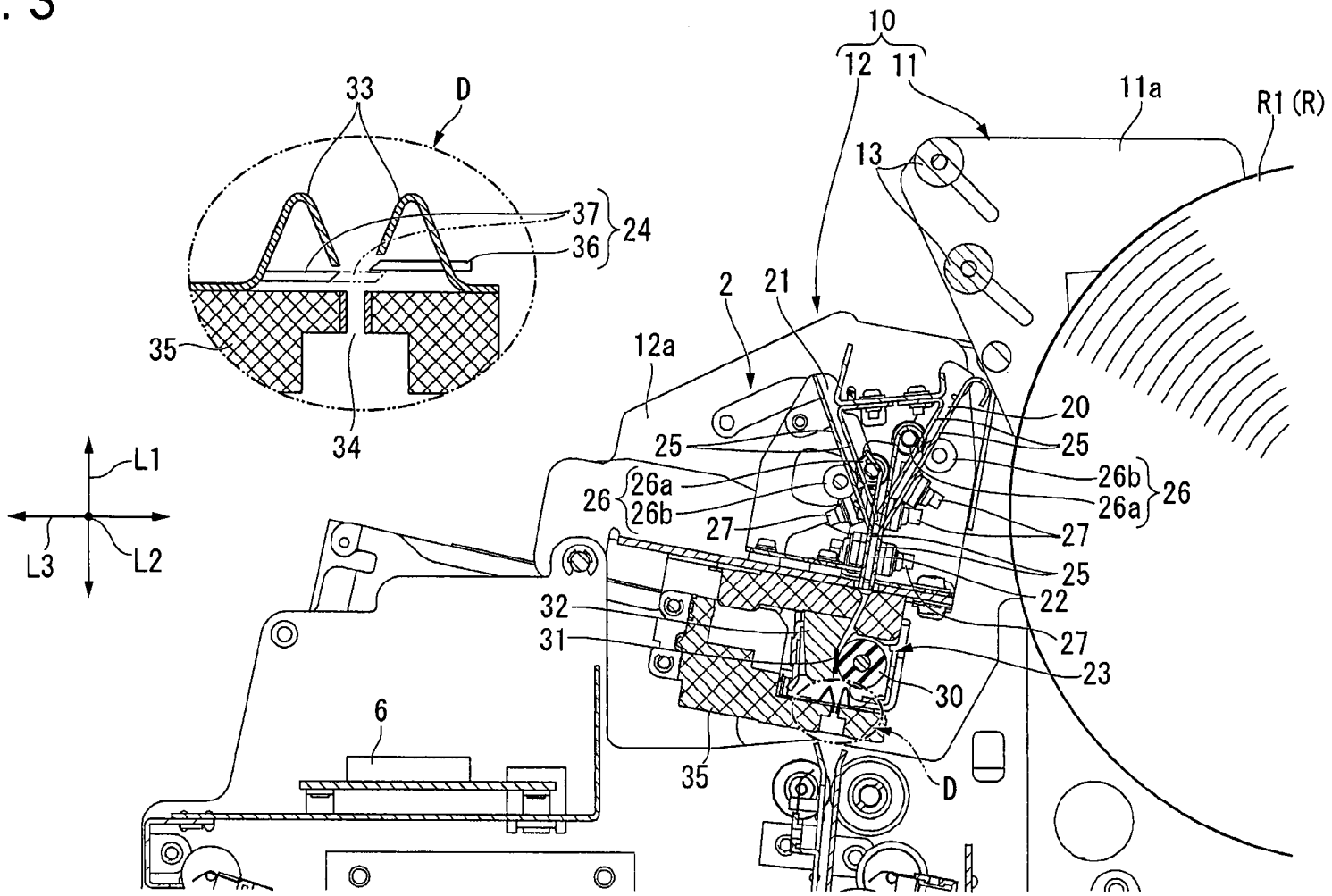
FIG. 3 is an enlarged sectional view of a periphery of a print unit of the printer illustrated in FIG. 2.

The print unit 2 mainly includes: as illustrated in FIG. 3, the first guide path 20 and the second guide path 21 for guiding downward the paper P pulled out from the main roll R1 and the paper P pulled out from the preliminary roll R2, respectively; a third guide path 22, into which those both guide paths 20 and 21 are merged, for guiding downward one of the paper P among the paper P within the both guide paths 20 and 21; a print section 23 arranged downward than the third guide path 22, for printing the paper P while feeding the paper; and the cutter mechanism 24 arranged downward than the print section 23, for cutting the paper P after being printed.

Note that, FIG. 3 is an enlarged sectional view of a periphery of the print unit 2 of the printer 1 illustrated in FIG. 2. Further, a portion surrounded (indicated) by an arrow D in FIG. 3 is illustrated by being enlarged in the same figure.

The first guide path 20, the second guide path 21, and the third guide path 22 are formed as paths each defined by plate members 25 each being arranged with a gap. Of those, the first guide path 20 and the second guide path 21 are arranged so as to align in the fore-and-aft direction L3. The first guide path 20 is positioned at the rear side, and the second guide path 21 is positioned at the front side. Further, those both guide paths 20 and 21 are formed so as to be inclined gradually toward downward, and are adapted to be merged at a lower end portion. Then, the third guide path 22 is formed, under a state in which the top end portion thereof is branched into the both guide paths 20 and 21, so as to extend downward.

For each of the first guide path 20 and the second guide path 21, there are formed roller portions 26 for feeding the paper P fed into each of the paths. The roller portions 26 include driving rollers 26*a* which rotate in receipt of instructions from a control section 6 described later, and driven rollers 26*b*, which rotate in association with the rotation of the driving rollers 26*a*, for feeding the paper P to downward while sandwiching the paper P between themselves and the driving rollers 26*a*.

Further, the first guide path 20 and the second guide path 21 are provided with sensors 27 for detecting the presence of the paper P at the downstream side of the roller portions 26. Those sensors 27 output the detection results to the control section 6.

With this, the control section 6 is enabled to detect, based on the detection results transmitted from those sensors 27, whether or not the main roll R1 or the preliminary roll R2 is out of paper. Further, the control section 6 controls the roller portions 26 based on the detection results transmitted from the sensors 27. As a result, the control section 6 enables the paper P pulled out from the main roll R1 or the paper P pulled out from the preliminary roll R2 to wait within the first guide path 20 or the second guide path 21.

Note that, the control section 6 basically controls so as to operate the roller portion 26 provided to the first guide path 20. With this, the paper P pulled out from the main roll R1 is adapted to be fed into the third guide path 22.

Then, when the main roll R1 is out of paper, the roller portion 26 provided to the second guide path 21 is operated to feed the paper P pulled out from the preliminary roll R2 into the third guide path 22.

Further, the third guide path 22 is provided with the sensor 27 for detecting the presence of the paper P, and the sensor 27 outputs the detection results to the control section 6. With this, the control section 6 is enabled to determine whether the paper P is properly fed toward the print section 23 without causing paper jam, or the like.

The print section 23 includes a platen roller 30, which extends toward a paper width direction of the paper P, and is rotated by a platen motor (not shown) which is driven based on an instruction from the control section 6, and a thermal head including heating elements (not shown) which are arrayed along the paper width direction of the paper P.

The thermal head 31 is pasted onto a head support plate urged by an urging means (not shown) toward the platen roller 30 side, and is brought into pressure contact with the outer peripheral surface of the platen roller 30. With this, the feeding of the paper P while sandwiching the paper P between the thermal head 31 and the platen roller 30 is enabled, and the clear printing is also enabled.

Then, the paper P, on which printing is performed by the print section 23, is adapted to pass through a cutter opening 34 while being guided by a leading guide 33. The leading guide 33 is a member fixed onto the print unit base 35 in which the cutter opening 34 is formed, and is fixed so as to oppose to each other across the cutter opening 34 therebetween. In this case, the leading guide 33 is formed so that a space inbetween is gradually decreased from the print section 23 toward the cutter opening 34, and bears a role of gradually guiding the paper P from the print section 23 to the cutter opening 34. Accordingly, it is constructed so that the paper P may be reliably fed through the cutter opening 34.

Note that, the paper P, which is fed through the cutter opening 34, is delivered to an input port 40 of the paper discharge unit 3.

By the way, on the print unit base 35, a fixed blade 36 and a movable blade 37, which is made slidable relative to the fixed blade 36, are provided. The movable blade 37 is constructed so as to slide substantially orthogonal relative to the feeding direction of the paper P by a slide mechanism (not shown) which is driven in receipt of an instruction from the control section 6. The movable blade 37 is a blade to cut the paper P between the fixed blade 36 like scissors at the time of sliding of the movable blade 37 while traversing the cutter opening 34. Specifically, those fixed blade 36 and the movable blade 37 function as the cutter mechanism 24 to cut the printed paper P.

(Paper Discharge Unit)

Next, description is made of the paper discharge unit 3.

As illustrated in FIG. 2, the paper discharge unit 3 of this embodiment is a unit which, after the paper P under printing operation is received through the input port 40 from the print unit 2 side, causes the paper P to wait inside until a printing operation and a cutting operation are ended, and after the respective processes are ended, also conveys the paper P to the discharge port 41 to discharge the paper P from the eject port 4*a* of the enclosure 4. In addition, when the discharged paper P was not received, the paper discharge unit 3 bears a role of reconveying the paper P from the discharge port 41 to the collection chamber 47 to throw the paper P into the collection chamber 47.

The paper discharge unit 3 is installed below the print unit 2 so as to be sandwiched between the side surface panels 12*a* of the second casing 12, and includes, as illustrated in FIG. 2, and FIG. 4 to FIG. 7, an input path 42, the waiting path 43, a collection path 44, conveyance mechanisms 45, an input mechanism 46, and the collection chamber 47.

Figure 4:
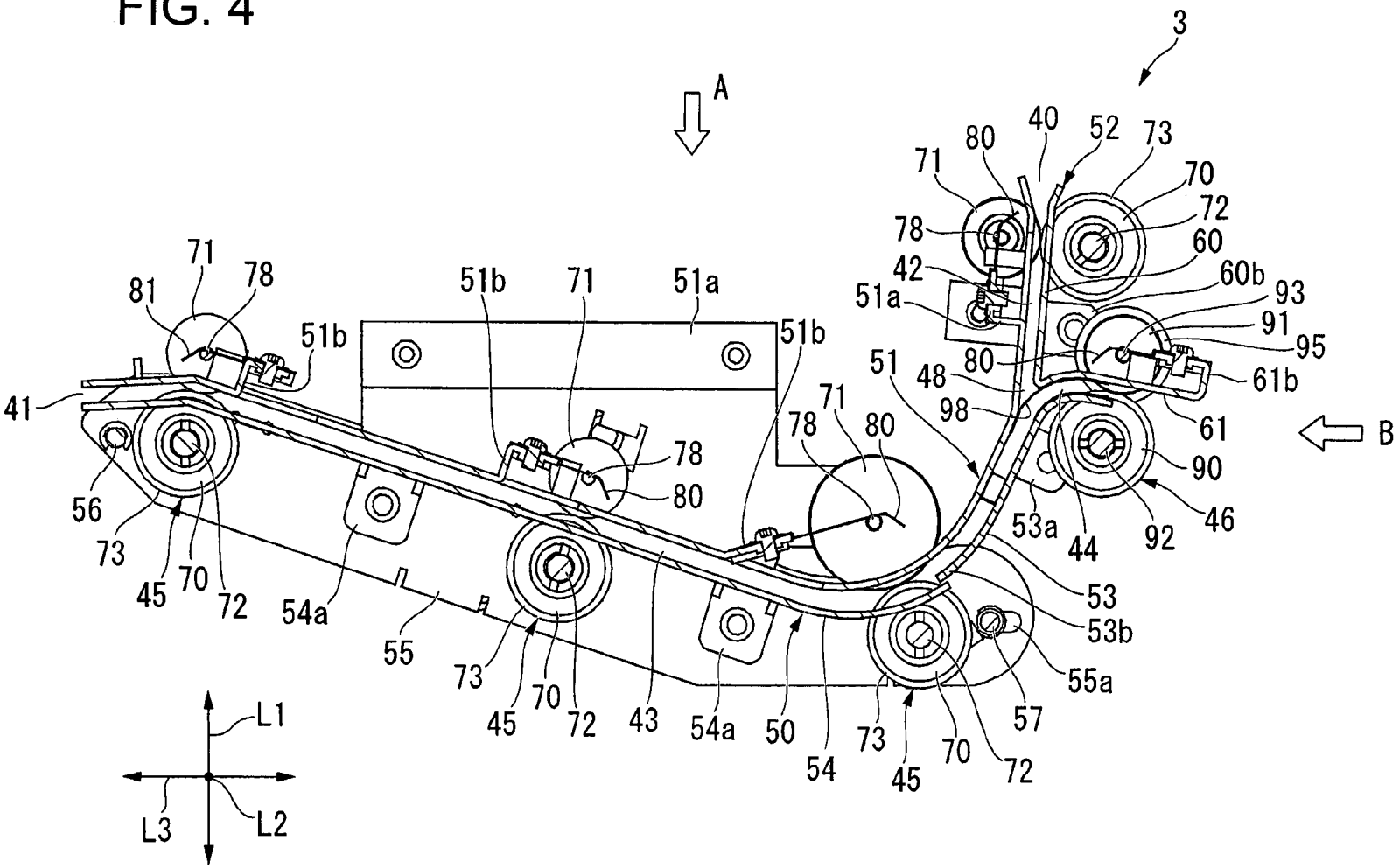
FIG. 4 is an enlarged sectional view of a paper discharge unit of the printer illustrated in FIG. 2.

Note that, FIG. 4 is an enlarged sectional view of the paper discharge unit 3 of the printer 1 illustrated in FIG. 2.

Figure 5:
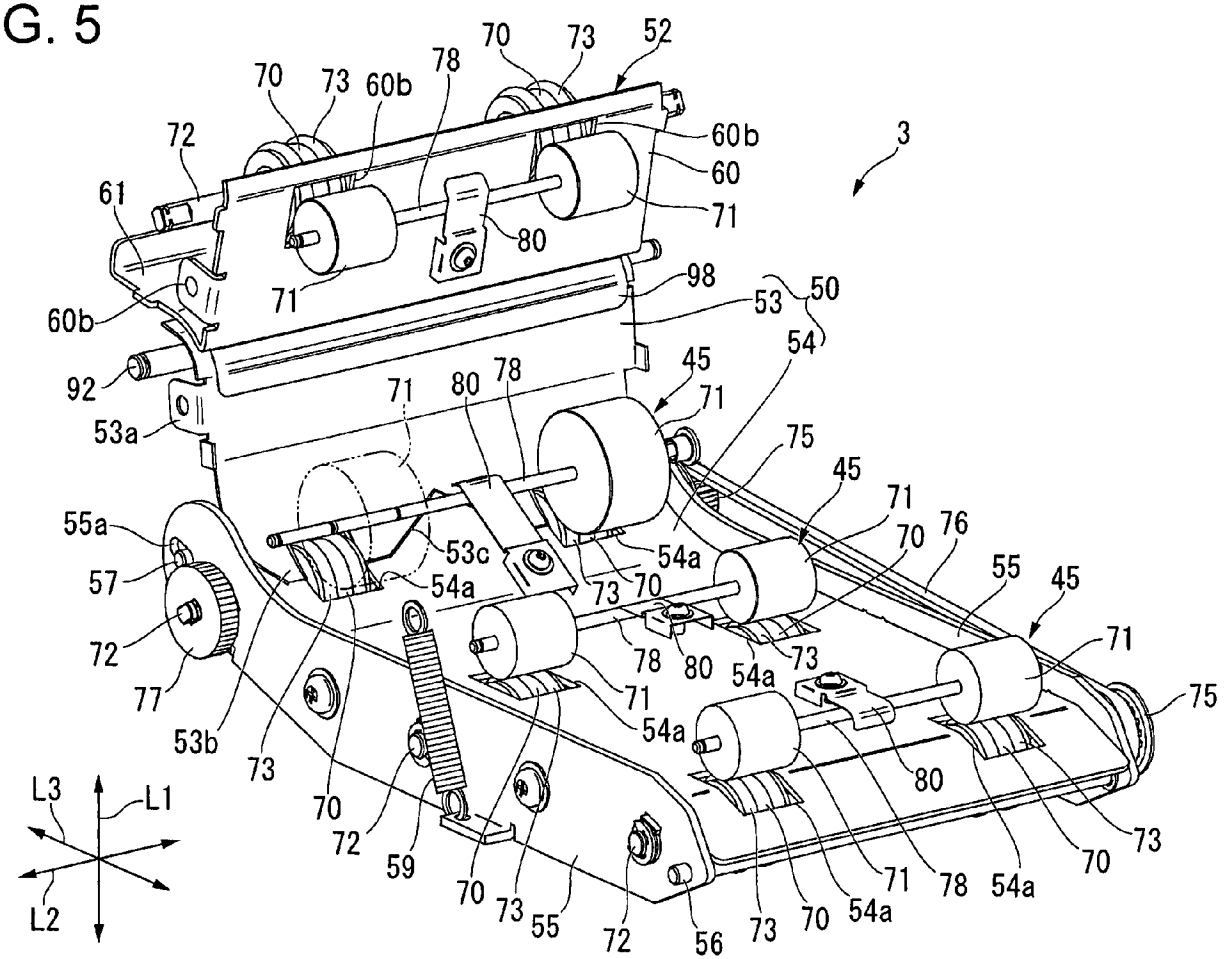
FIG. 5 is a perspective view of the paper discharge unit illustrated in FIG. 4.
Figure 6:
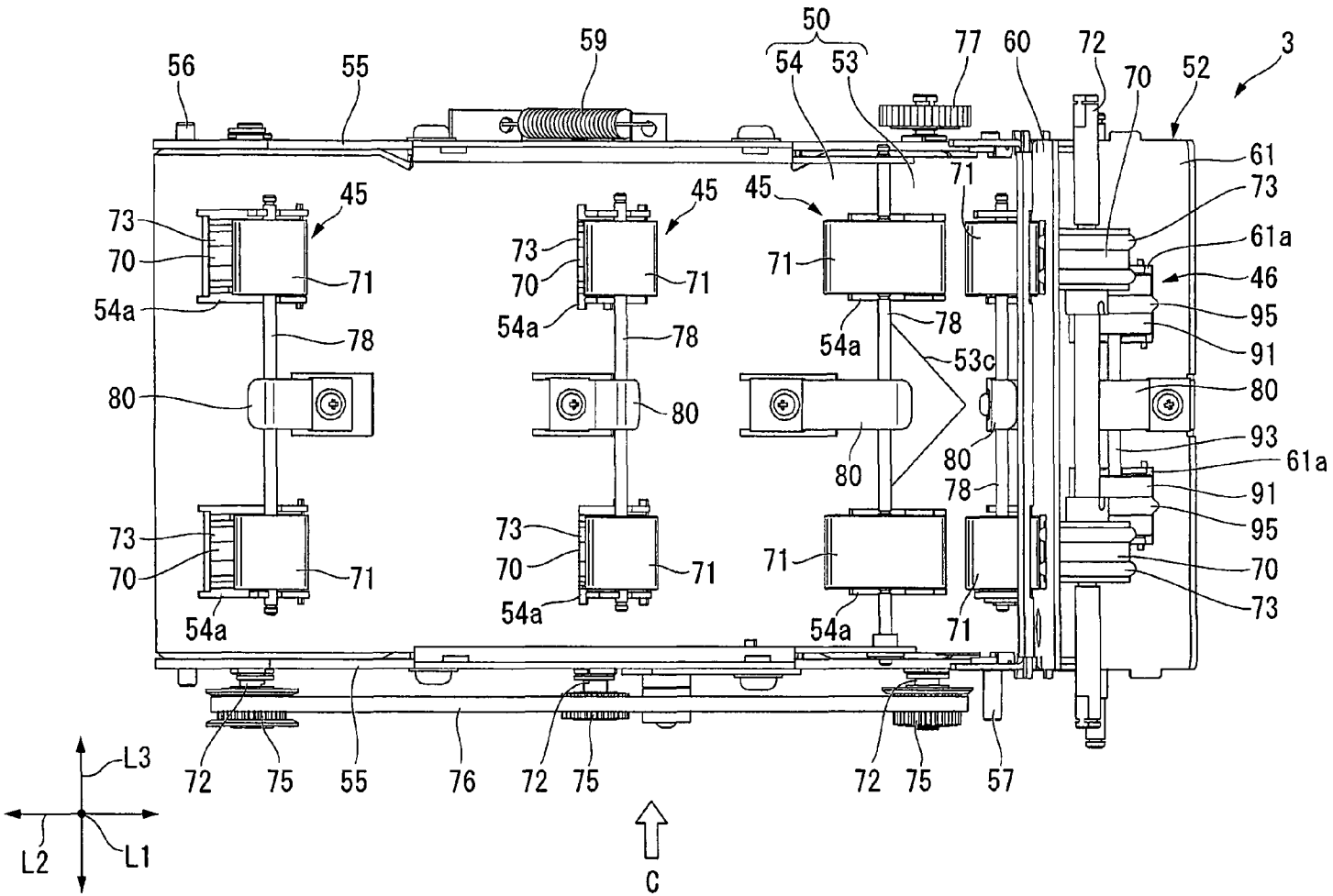
FIG. 6 is a top view of the paper discharge unit viewed from an arrow A direction of FIG. 4.
Figure 7:
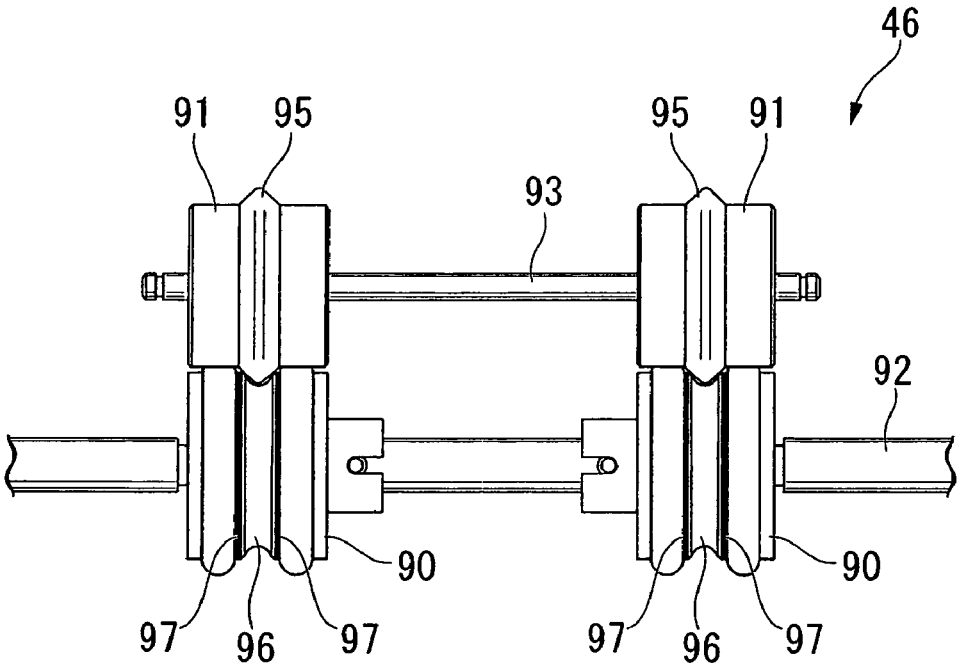
FIG. 7 is a side view of an input mechanism constituting the paper discharge unit, which is viewed from an arrow B direction of FIG. 4.
Figure 7:
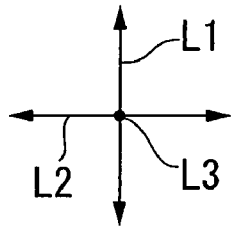

FIG. 5 is a perspective view of the paper discharge unit 3 illustrated in FIG. 4. FIG. 6 is a top view of the paper discharge unit 3, which is viewed from an arrow A direction of FIG. 4. FIG. 7 is a side view of an input mechanism 46 constituting the paper discharge unit 3, which is viewed from an arrow B direction of FIG. 4. Provided that the illustration of a cover plate 51 is omitted in FIG. 5 and FIG. 6.

The respective paths are constructed of a base plate 50 for guiding the paper P, a cover plate 51 which is overlapped with respect to the base plate 50 with a gap, to thereby define a path between itself and the base plate 50 capable of conveying the paper P, and a direction changing plate 52 which is overlapped with respect to the top end portion of the base plate 50 and the top end portion of the cover plate 51 with gaps, respectively, to thereby define a path capable of conveying the paper P between the both plates 50 and 51.

Of those, the input path 42 is a path, which connects on one side (upper side) to the input port 40, and also connects on another side (lower side) to a merged portion 48. The waiting path 43 is a path, which connects on one side (upper side) to the merged portion 48, and also connects on another side (front side) to the discharge port 41 so that the paper P conveyed through the input path 42 is guided. The collection path 44 is a path, which connects on one side (front side) to the merged portion 48, and also connects on another side (rear side) to the collection chamber 47 so that the paper P, which is conveyed in the waiting path 43 in the reverse direction (direction directed from the discharge port 41 to the merged portion 48) is guided.

Note that, in this embodiment, description is made of a case where the waiting path 43 is connected through the input path 42 to the input port 40 by way of example.

Detailed description is made of those respective paths.

First, the base plate 50 is formed such that a width thereof is longer than the width of the paper P, and after the base plate 50 once falls from the top end portion toward downward on the front side, the base plate 50 is bent upward and rises while being inclined linearly toward the front side as it is.

Then, the base plate 50 of this embodiment is constructed of two sheets of plates including a first base plate 53 and a second base plate 54, and under a state in which parts of the plates are overlapped to each other, the base plates are arranged so as to be aligned in the fore-and-aft direction L3. In this case, a portion from the top end portion to near the lowermost portion of the base plate 50 is defined as the first base plate 53, and a portion positioned forward than the first base plate 53 is defined as the second base plate 54.

The first base plate 53 is fixed to the side surface panels 12*a* of the second casing 12 through mounting pieces 53*a* fixed to both right and left sides. Then, the top end portion of the first base plate 53 is formed so as to bend toward the backward. Further, the lower end portion of the first base plate 53 is formed as the overlapped portion 53*b* overlapping on the second base plate 54.

The second base plate 54 is fixed to a pair of side wall plates 55 so as to be sandwiched therebetween through mounting pieces 54*a* mounted on both right and left sides thereof. The pair of side wall plates 55 are plates extending in the fore-and-aft direction L3 following the shape of the second base plate 54, and firmly fix the second base plate 54 while sandwiching from both right and left sides.

At the front end portion of the pair of side wall plates 55, a front shaft 56 extending in the transverse direction L2 penetrates therethrough, and both end portions of the front shaft 56 project outwardly right and left from the side wall plates 55. Then, the projected both end portions of the front shaft 56 are axially supported to the side surface panels 12*a* of the second casing 12. Therefore, the second base plate 54 is fixed to the second casing 12 through the front shaft 56 and the pair of side wall plates 55, and in addition, is rotatable about the front shaft 56 as a center.

Note that, the front end portion of the second base plate 54 is positioned so as to adjacent to the inside of the eject port 4*a* of the enclosure 4.

Figure 8:
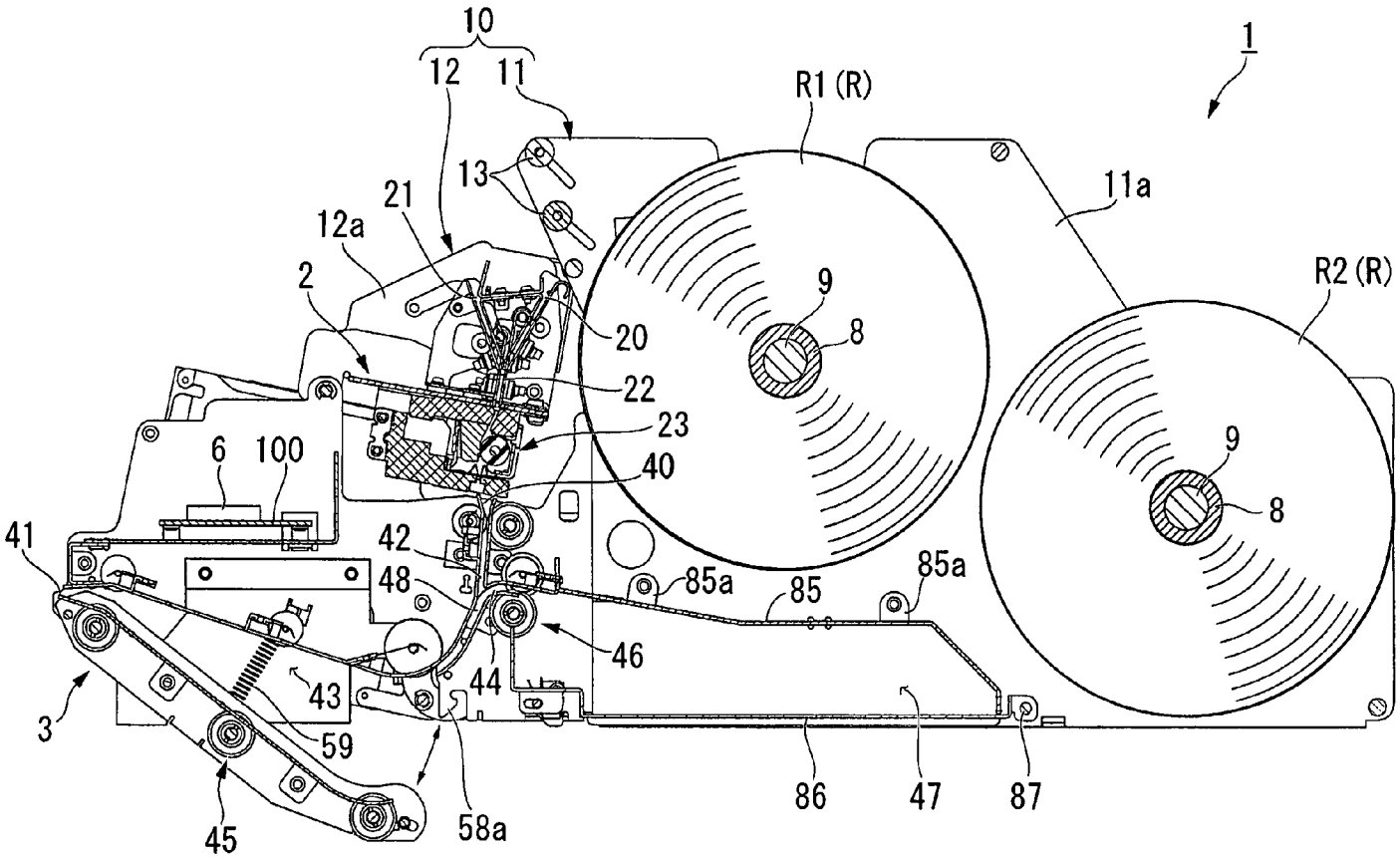
FIG. 8 illustrates a state in which a second base plate is brought into an opened state from a state illustrated in FIG. 2.

Further, at the rear end portions of the pair of side wall plates 55, a rear shaft 57 also extending in the transverse direction L2 penetrates therethrough, and the both end portions of the rear shaft 57 project outwardly right and left than the side wall plates 55. Then, the projected both end portions of the rear shaft 57, as illustrated in FIG. 8, are allowed to engage with engagement claws 58*a* formed in the side surface panels 12*a* of the second casing 12. Note that, FIG. 8 illustrates a state in which a second base plate 54 is brought into an opened state from a state illustrated in FIG. 2.

Specifically, through engagement of the both end portions of the rear shaft 57 with the engagement claws 58*a*, as illustrated in FIG. 2, the second base plate 54 may be locked into a closed state, and also through disengagement of the both end portions of the rear shaft 57 with the engagement claws 58*a*, as illustrated in FIG. 8, the lock of the second base plate 54 may be released into an opened state, thereby being capable of separating from the cover plate 51. That is, of the base plates 50, the second base plate 54 is made separable with respect to the cover plate 51, thereby bearing a role of releasing within the waiting path 43.

Note that, the rear shaft 57 is caused to penetrate, as illustrated in FIG. 4 and FIG. 5, through long holes 55*a* formed in the pair of side wall plates 55. In this case, the rear shaft 57 is urged by an urging means such as a coil spring (not shown) toward the direction so as to be engaged with the engagement claws 58*a*. Therefore, it is designed so that the engagement does not easily. released when the both end portions of the rear shaft 57 are engaged with the engagement claws 58*a*.

Further, between the side wall plates 55 and the side surface panels 12*a* of the second casing 12, as illustrated in FIG. 5 and FIG. 8, a coil spring 59 for lifting the second base plate 54 upward is installed. Accordingly, the second base plate 54 is hard to be the opened state suddenly, and in addition, designing is made so as to be liable to be naturally returned to the closed state after being set into the opened state.

Further, when the second base plate 54 is closed, as illustrated in FIG. 4 and FIG. 5, the rear end portion of the second base plate 54 is configured so as to be brought into intimate contact from downward with the overlapping portion (lower end portion) 53*b* of the first base plate 53. As a result, it is designed so that a gap is not caused between the first base plate 53 and the second base plate 54.

Next, description is made of the direction changing plate 52.

The direction changing plate 52 is a plate formed into an L-shape when viewed from the side surface, as illustrated in FIG. 2, and FIG. 4 to FIG. 6, with a vertical plate 60 extending in the vertical direction Ll and a rear plate 61 extending from the lower end of the vertical plate 60 toward backward, and is fixed to the side surface panels 12*a* of the second casing 12 through mounting pieces 60*b* fixed to both right and left side of the vertical plate 60.

In this case, a rear plate 61 of the direction changing plate 52 is opposed to the top end portion of the first base plate 53 (curved portion toward backward) with a gap, and, the top end portion of the vertical plate 60 is fixed so as to positioned below the cutter opening 34 of the print unit 2.

Next, description is made of the cover plate 51.

The cover plate 51 is, as illustrated in FIG. 2 and FIG. 4, partially curved so as to follow the shapes of the vertical plate 60 and the base plate 50 constituting the direction changing plate 52, and is fixed to the side surface panels 12*a* of the second casing 12 through mounting pieces 51*a* fixed to both right and left sides thereof under a state of being arranged so as to be opposed with respect to the vertical plate 60 and the base plate 50 with a gap, respectively.

The top end portion of the cover plate 51 is a portion opposing the top end portion of the vertical plate 60 constituting the direction changing plate 52, and is positioned below the cutter opening 34 of the print unit 2. Then, the interval between the top end portion of the cover plate 51 and the top end portion of the vertical plate 60 functions as the input port 40 for receiving the paper P being fed from the print unit 2.

On the other hand, the front end portion of the cover plate 51 is a portion opposing the front end portion of the second base plate 54 constituting the base plate 50, and is positioned so as to be adjacent to the inside of the eject port 4*a* of the enclosure 4. Then, the interval between the front end portion of the cover plate 51 and the second base plate 54 functions as the discharge port 41 for discharging the paper P.

Further, a path which is defined by the cover plate 51 and the vertical plate 60 constituting the direction changing plate 52 functions as the input path 42 to be connected to the input port 40. Further, a path which is defined by the cover plate 51 and the base plate 50 functions as the waiting path to be connected to the discharge port 41. Further, a portion defined by the rear plate 61 constituting the direction changing plate 52 and the top end portion of the first base plate 53 (portion curved toward backward) functions as the collection path 44. In addition, a portion, at which the input path 42, the waiting path 43, and the collection path 44 are intersected, functions as the merged portion 48.

Like this, in this embodiment, if the paper P is fed through the input port 40 from the print unit 2, the paper P is adapted to be fed naturally to the waiting path 43 after passing through the input path 42 without entering into the collection path 44.

Further, in the waiting path 43 of this embodiment, the interval between the merged portion 48 and the discharge port 41 is formed into a curve so as to be swelled downward. With this, it is possible to sufficiently secure the length of the waiting path 43, and to cause the paper P to wait reliably within the waiting path 43, even if the paper P has a long print length until processings such as printing and cutting are ended.

Note that, as occasion demands, through rotating about the front shaft 56 the second base plate 54 constituting the base plate 50, as illustrated in FIG. 8, the inside of the waiting path 43 is enabled to be released.

Next, description is made of the conveyance mechanism 45.

A plurality of the conveyance mechanisms 45 are provided along the waiting path 43, and execute a role for conveying the paper P which was conveyed through the input path 42 until the discharge port 41 in the forward direction, and for conveying, after lapse of a given period of time after the conveyance of the paper P, the paper P in the reverse direction through the merged portion 48 to feed into the collection path 44.

Specifically, as illustrated in FIG. 2, and FIG. 4 to FIG. 6, the conveyance mechanisms 45 are provided to the base plate 50 side, and include driving rollers 70 which convey the paper P in a forward direction (direction directing toward the discharge port 41) or a reverse direction (direction directing toward the merged portion 48), and driven rollers 71, which are provided on the cover plate 51 side to be driven rotated in contact with the driving rollers 70 between the base plate 50 and the cover plate 51, and are capable of sandwiching the paper P between themselves and the driving rollers 70.

Note that, in this embodiment, description is made of a case where the driving rollers 70 and the driven rollers 71 are each formed at three portions along the waiting path by way of example, but is not limited to three portions. Depending on the length of the waiting path 43, it may appropriately be altered.

The driving rollers 70 are each arranged so as to be positioned at three positions including the rear end portion (portion overlapping with the first base plate 53) side of the second base plate 54 constituting the base plate 50, the discharge port 41 side, and an intermediate portion of the both portions. The two driving rollers 70 are aligned per one portion with a gap in the transverse direction L2. That is, total six pieces of the driving rollers 70 are provided on the base plate 50 side.

The two driving rollers 70 aligned in the transverse direction L2 are fixed to a roller shaft portion 72 axially supported by the pair of side wall plates 55 fixing the second base plate 54. Note that, parts of the outer peripheral surfaces of the respective rollers 70 are exposed into the waiting path 43 through roller opening portions 54*a* formed in the second base plate 54. Further, two antislipping rings 73 formed of an elastic material, such as rubber, are wound around on the outer peripheral surfaces of the respective rollers 70.

Figure 9:
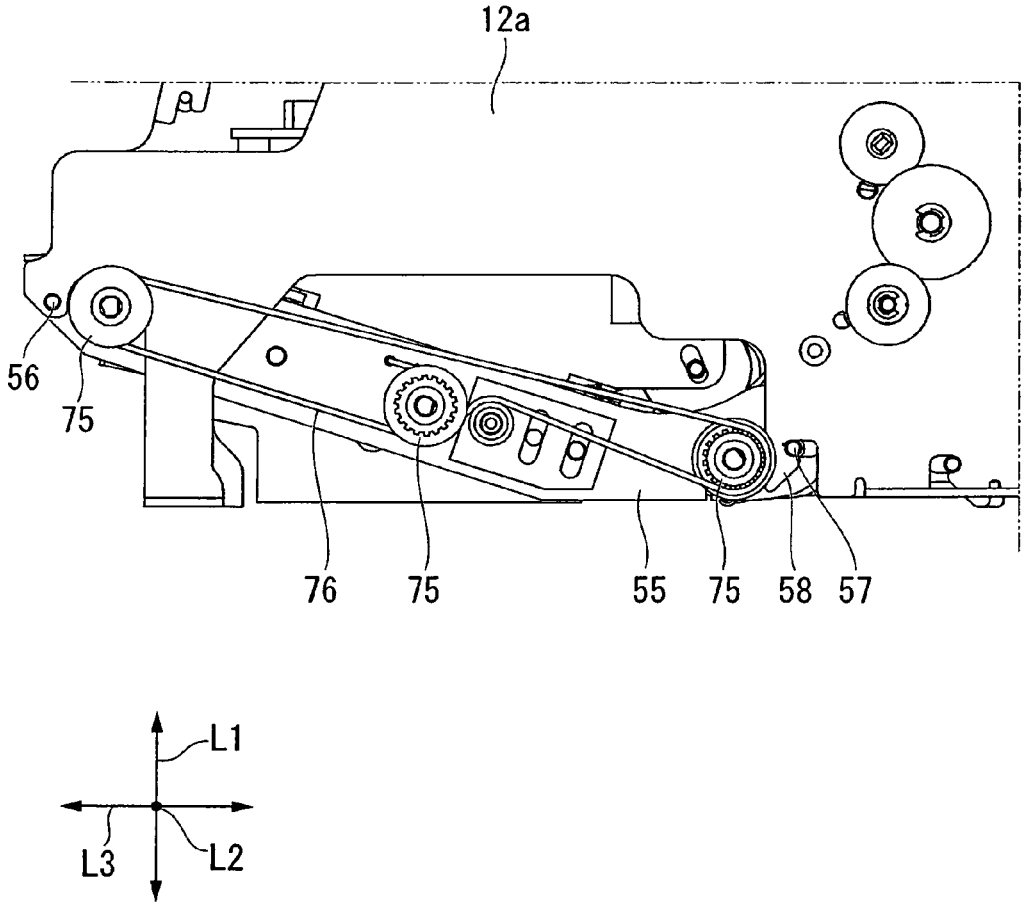
FIG. 9 is a partially side view of the paper discharge unit viewed from an arrow C direction of FIG. 6.

By the way, one end portions of the three roller shaft portions 72 are projected outward of the side wall plates 55, and pulleys 75 are coupled to the projected portions, respectively. Then, as illustrated in FIG. 9, an endless belt 76 is wound around the respective pulleys 75. With this, the respective pulleys 75 are designed so as to be rotated through the endless belt 76 by the same rotation amount in the same direction. Note that, FIG. 9 is a partially side view of the paper discharge unit 3 viewed from an arrow C direction of FIG. 6.

Note that, as illustrated in FIG. 5 and FIG. 6, a gear 77, which rotates in receipt of driving of the motor (not shown), is fixed to another end portion of the roller shaft portions 72 positioned at the rear end portion side of the second base plate 54. With this, the rest roller shaft portions 72 rotate by the same amount in the same direction through the endless belt 76. Note that, the motor is adapted to operate in receipt of an instruction from the control section 6, and also to suitably switch the rotation direction of the motor between forward and reverse.

The driven rollers 71 are provided six in total, as illustrated in FIG. 4 to FIG. 6, so as to be brought into contact with the respective rollers 70. In other words, the driven rollers 71 are arranged at three portions in the fore-and-aft direction L3, and two are aligned with an interval in the transverse direction L2 per one portion. Then, the driven rollers 71 aligned by two in the transverse direction L2 are fixed to roller shaft portions 78 which are axially supported to the cover plate 51.

By the way, a plate spring (urging member) 80, which urges, toward the base plate 50 side, the roller shaft portions 78 which axially support the driven rollers 71, is fixed to the cover plate 51 through a bending strip 51*b*. With this, the driven rollers 71 and the driving rollers 70 are brought into a pressure connect state with each other. Note that, the driven rollers 71 are, similarly to the driving rollers 70, exposed into the waiting path 43 through the roller opening portion (not shown) formed in the cover plate 51. Note that, in FIG. 5 and FIG. 6, illustration of the bending strip 51*b* is omitted.

The conveyance mechanisms 45 are constructed as described above, through the forward and reverse rotations by driving of the motor, the paper P is enabled to be reliably conveyed while sandwiching the paper P between the driving rollers 70 and the driven rollers 71 along the waiting path 43 in the forward direction or in the reverse direction.

By the way, when the paper P is conveyed in the forward direction, the paper P is conveyed so as to throw down from the first base plate 53 to the second base plate 54 at the overlapping portion of the first base plate 53 constituting the base plate 50 and the second base plate 54, and hence the paper P may be fed smoothly without being caught, or the like.

Contrary to this, when the paper P is conveyed in the reverse direction, the paper P passes so as to over a step portion of the first base plate 53 overlapping with the second base plate 54. In this case, too, in this embodiment, the first base plate 53 and the second base plate 54 are adapted to overlap with each other so that the paper P may smoothly return without being caught.

Specifically, the first base plate 53 and the second base plate 54 are, as illustrated in FIG. 4 and FIG. 5, mainly overlapped at the portions where the driving rollers 70 are arranged. The overlapped portion 53*b* (lower end portion) of the first base plate 53 is cut into a V-shape in plan view between the two driving rollers 70 aligned in the transverse direction L2. Specifically, at the overlapped portion 53*b* of the first base plate 53, a cutout portion 53*c* which is cut out into the V-shape toward the merged portion 48 is formed between the two driving rollers 70.

With this, when the paper P is conveyed in the waiting path 43 in the reverse direction, even if a center portion in the paper width direction is bent so that the paper P may have contacts with the second base plate 54 between the two driving rollers 70, as the step of the first base plate 53 and the second base plate 54 is formed into the V-shape following the cutout portion 53*c*, it is constructed such that the paper P is hard to be caught by those steps, and returns to the merged portion 48 while smoothly passing over the steps.

Further, in this embodiment, the driving rollers 70 and the driven rollers 71 are also provided to the input path 42. Specifically, the driving rollers 70 are provided to the vertical plate 60 side, which constitutes the direction changing plate 52, and the driven rollers 71 are provided to the cover plate 51 side so as to be brought into contact with the driving rollers 70.

The driving rollers 70 are arranged so as to align two in the transverse direction L2 with an interval in the vicinity of the input port 40, and is fixed to the roller shaft portions 72. In this case, parts of the outer peripheral surfaces of the driving rollers 70 are exposed into the input path 42 through the roller opening portions 60*a* formed in the vertical plate 60.

Note that, the roller shaft portions 72 are mechanically coupled to the driving shaft of the above-mentioned motor, and are adapted to conduct the forward and reverse rotation interlocking with the driving of the motor.

Further, the driven rollers 71 are aligned two in the transverse direction L2 with an interval, and are fixed to the roller shaft portions 78 axially supported by the cover plate 51. Then, those two driven rollers 71 are brought into contact with the driving rollers 70 within the input path 42. Further, the driven rollers 71 are under a pressure connect state with the driving rollers 70 by the plate spring 80 urging the roller shaft portions 78 toward the vertical plate 60 side.

Next, description is made of the collection chamber 47.

The collection chamber 47 is a space, as illustrated in FIG. 2, for collecting the paper P when the paper P discharged from the eject port 4*a* of the enclosure 4 was not received by the user.

The collection chamber 47 of this embodiment is defined by a top board portion 85, a bottom plate portion 86, the side surface panels 11*a* of the first casing 11, and the side surface panels 12*a* of the second casing 12, and is provided mainly below the main roll R1 under a state in which the front side thereof is connected to the collection path 44.

Figure 10:
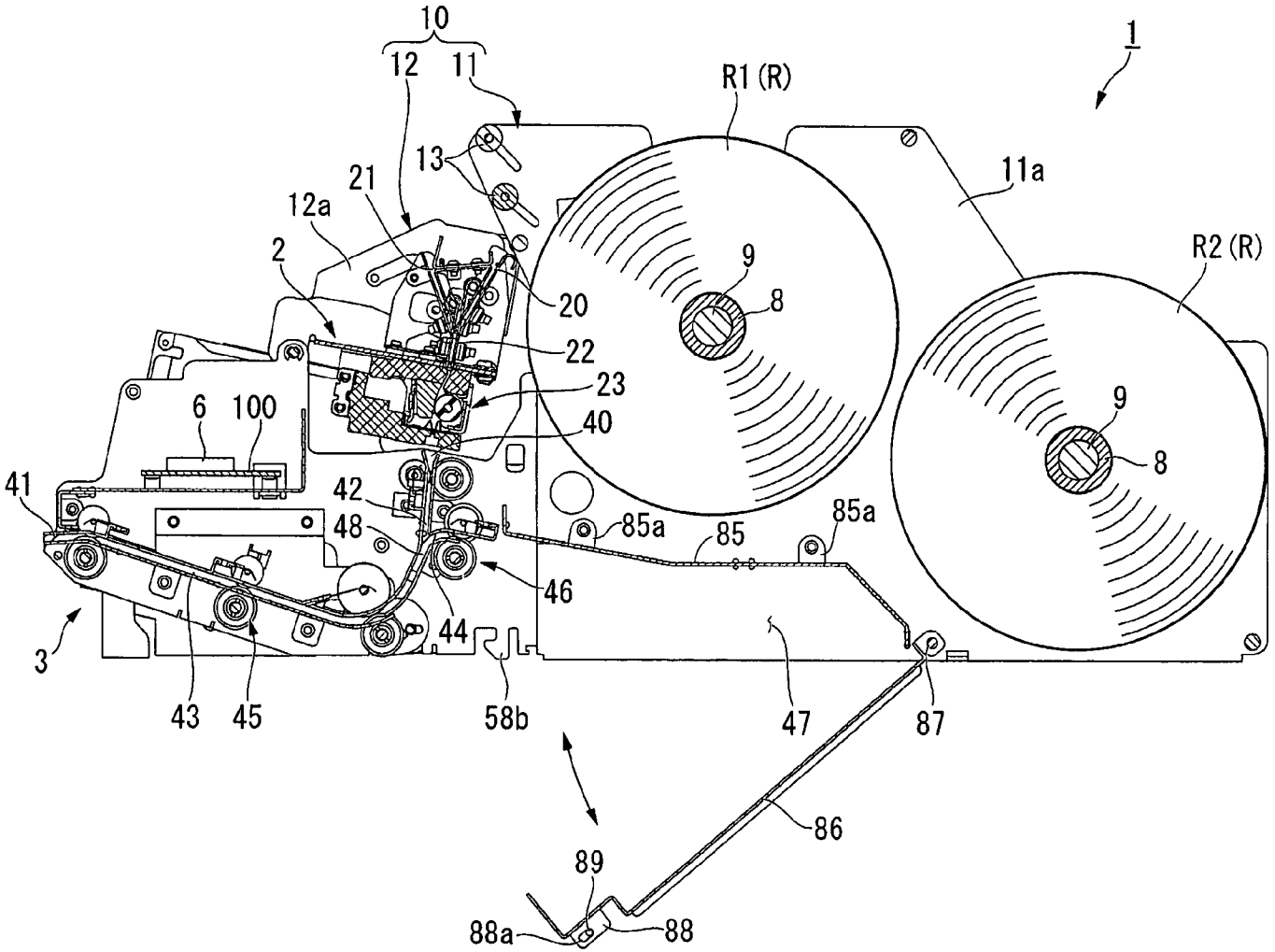
FIG. 10 illustrates a state in which a bottom plate portion of a collection chamber is brought into an opened state from the state illustrated in FIG. 2.

The top board portion 85 constituting the collection chamber 47 is fixed to the side surface panels 11*a* of the first casing 11 through mounting pieces 85*a* fixed to both right and left side. Further, the rear end portion of the bottom plate portion 86 is axially supported by a rotation shaft portion 87 fixed to the side surface panels 11*a* of the first casing 11. Accordingly, the bottom plate portion 86 is designed, as illustrated in FIG. 10, to rotate about the rotation shaft portion 87 as a center to be opened and closed. With this, the paper P collected within the collection chamber 47 is allowed to be suitably taken out, thereby being capable of easily disposing.

Note that, FIG. 10 illustrates a state in which a bottom plate portion 86 is brought into an opened state from the state illustrated in FIG. 2.

Note that, fixed plates 88 each having a long hole 88*a* formed therein are formed at both right and left sides on the front side of the bottom plate portion 86. Then, a fixed shaft portion 89 extending in the transverse direction L2 penetrates each of the long holes 88*a*, and the both end portions of the fixed shaft portion 89 are projected outward on right and left direction than the fixed plate 88. Then, the both end portions of the fixed shaft portion 89 are allowed to engage with engagement claws 58*b* formed in the side surface panels 12*a* of the second casing 12.

With this, through the engagement of the both end portions of the fixed shaft portion 89 with the engagement claws 58*b*, as illustrated in FIG. 2, the bottom plate portion 86 may be locked at a closed state. In this case, the fixed shaft portion 89 is urged, by urging means such as a coil spring (not shown), toward a direction so as to be engaged with the engagement claws 58*b*. Therefore, designing is carried out so that the bottom plate portion 86 of the collection chamber 47 may not easily be opened.

Next, description is made of the input mechanism 46.

The input mechanism 46 is, as illustrated in FIG. 2, FIG. 4 and FIG. 7, a mechanism provided to the collection path 44, for conveying the paper P, which is fed from the waiting path 43, toward the downstream side (rear side) to throw the paper P into the collection chamber 47. Further, the input mechanism includes driving rollers (another side roller) 90 which rotates while sandwiching the paper P, and driven rollers (one side roller) 91, and bears a role to convey the paper P while forming folds M across the total length of the paper P along the conveying direction with the both rollers 90 and 91.

The driving rollers 90 are aligned two with an interval in the transverse direction L2 at the rear end portion of the first base plate 53 constituting the base plate 50. Then, those driving rollers 90 are fixed to a roller shaft portion axially supported to the side surface panels 12*a* of the second casing 12. In this case, parts of the outer peripheral surfaces of the driving rollers 90 are exposed into the collection path 44 through the roller opening portions (not shown) formed in the first base plate 53.

Note that, the roller shaft portions 92 are mechanically coupled to the driving shaft of the above-mentioned motor, and are adapted to conduct rotation interlocking with the driving of the motor. In this case, between the roller shaft portion of the input mechanism 46 and the driving shaft of the motor, there is interposed a one-way clutch (not shown), which transmits a rotating force to the roller shaft portion 92 when the driving shaft of the motor rotates in one direction, and when the driving shaft of the motor rotates in the reverse direction, which performs an idle rotation to regulate the rotation force from being transmitted to the roller shaft portion 92.

In this embodiment, designing is made so that, by the one-way clutch, the driving roller 90 rotates only in such a direction that the paper P fed into the collection path 44 is conveyed to the collection chamber 47 side. Specifically, when the driving rollers 70 constituting the conveyance mechanisms conveys the paper P in the forward direction toward the discharge port 41 along the waiting path 43, the driving roller 90 of the input mechanism 46 is adapted to be not rotated.

Further, the driven rollers 91, which are aligned two in the transverse direction L2 with an interval, are fixed to a roller shaft portion 93 axially supported to the rear plate 61 constituting the direction changing plate 52. Then, the two driven rollers 91 are brought into contact with the driving roller 90 within the collection path 44 through roller opening portion 61*a* formed in the rear plate 61. Further, the driven roller 91 is also under a pressure connect state with the driving rollers 70 by the plate spring 80 urging the roller shaft portion 93 toward the first base plate 53 side.

Note that, the plate spring 80 is fixed to the rear plate 61 through the bending strip 61*b*.

By the way, on the outer peripheral surface of the driven roller 91 of the above-mentioned input mechanism 46, there is formed an annular projection 95 which is swelled into a V-shape radially outward. Contrary to this, on the outer peripheral surface of the driving roller 90, there is formed an annular groove 96, which is recessed into a V-shape, and into which the annular projection 95 is fitted.

For that reason, it is constructed so that, when the paper P is fed into the collection chamber 47, two V-shaped folds M (refer to FIG. 2) along the conveying direction may be imparted across the total length of the paper P. Detailed description of this point will be made later.

In addition, onto the outer peripheral surface of the driving roller 90, two ring-shape anti-slipping members 97 are attached with a space, and the annular groove 96 is formed between those anti-slipping members 97. With this, when imparting the folds onto the paper P by the annular projection 95 and the annular groove 96, it is possible to impart the clear folds M while suppressing sideslipping of the paper P. Description of this point will also be made later in detail.

Further, at the merged portion 48 of the paper discharge unit 3 of this embodiment, as illustrated in FIG. 4, a leading strip (leading member) 98 is provided for leading the paper P, which was conveyed in the reverse direction in the waiting path 43, to the collection path 44 side. The leading strip 98 is a sheet-like member having a flexibility or an elasticity, its root side is fixed to the rear plate 61 constituting the direction changing plate 52, and a leading end side thereof is brought into contact with the cover plate 51 so as to block the input path 42.

With this, when the paper P is fed from the input path 42, it is possible to reliably convey the paper P toward the waiting path 43 side while pushing up the leading strip 98. On the other hand, when the paper P is conveyed in the reverse direction in the waiting path 43, the paper P is allowed to direct naturally toward the collection path 44 side by the leading strip 98.

Further, at the merged portion 48 of the paper discharge unit 3 of this embodiment, as illustrated in FIG. 4, a leading strip (leading member) 98 is provided for leading the paper P, which was conveyed in the reverse direction in the waiting path 43, to the collection path 44 side. The leading strip 98 is a sheet-like member having a flexibility or an elasticity, its root side is fixed to the rear plate 61 constituting the direction changing plate 52, and a leading end side thereof is brought into contact with the cover plate 51 so as to block the input path 42.

By the way, as illustrated in FIG. 2, the control section is mounted onto a control board 100 fixed to the first casing 11 so as to be positioned at the front of the print unit 2. Note that, other various electronic devices (not shown) are also mounted onto the control board 100.

The control section 6 totally controls the print unit 2 and the paper discharge unit 3, and the controls of both units 2 and 3 are executed in accordance with an instruction input from an operation panel 5. Specifically, the print unit 2 is activated to perform the printing on the paper P pulled out from the main roll R1, and thereafter, the cutting of the paper P at a predetermined length is executed. Then, after cutting, the paper P is conveyed to the discharge port 41 by the paper discharge unit 3, and is caused to discharge through the eject port 4*a* of the enclosure 4. Then, the control is performed such that, if a given period time has elapsed without the paper P being received by the user, the paper P is conveyed again so to be collected within the collection chamber 47.

Next, description is made of a case where the printer 1 constructed as described above is operated.

First, as an initial state, as illustrated in FIG. 2, the paper P each pulled out from the main roll R1 and the preliminary roll R2 are guided into the first guide path 20 and the second guide path 21 of the print unit 2, and are assumed as the waiting state.

Here, when a user uses ATM of CD, the user operates the operation panel 5 to conduct account processing, and if the account processing is ended, the control section 6 activates the print unit 2 and the paper discharge unit 3 in order to issue a statement of account.

Then, the print unit 2 activates the driving roller 26*a* of the roller portion 26, the platen roller 30, and the thermal head 31 which are provided within the first guide path 20. First, through the activation of the driving roller 26*a*, the paper P being waited in the first guide path 20 is fed into the third guide path 22 on the downstream side, and also is fed to the print section 23 on further downstream side while passing through the third guide path 22 as it is. Then, the paper P fed into the print section 23 is fed toward downstream while being sandwiched between the platen roller 30 and the thermal head 31. In this case, multiple numbers of heating elements are suitably generating heat due to activation of the thermal head 31, and with respect to the paper P which was fed, various kinds of characters, graphics, and the like may be clearly printed.

Then, the printed paper P is fed toward downstream side while being guided by the leading guide 33, and is fed into the input port 40 on the paper discharge unit 3 side while passing through the cutter opening 34.

Here, the paper discharge unit 3 is activated simultaneously with the activation of the print unit 2 in receipt of instruction from the control section 6. Specifically, in accordance with a feeding speed of the paper P being fed from the print unit 2 side, the motor is operated to rotate. In this case, the motor is rotated so that the paper P is conveyed in the forward direction from the input port 40 toward the discharge port 41.

For that reason, when the paper P under printing processing is fed into the input path 42 from the print unit 2 side through the input port 40, the paper P is fed toward downstream side while being sandwiched between the driving rollers 70 and the driven rollers 71 within the input path 42. Then, the paper P, which has been fed toward the downstream, is fed into the waiting path 43 after passing through the merged portion 48. Then, the paper P is fed toward the discharge port 41 positioned at the downstream side while being sandwiched between the driving rollers 70 and the driven rollers 71 constituting the conveyance mechanisms 45.

Like such way, the paper P stays and waits within the waiting path 43 until the printing by the print unit 2 is ended without being discharged from the discharge port 41. Then, after the printing of necessary information is ended, the print unit 2 activates the cutter mechanism 24 to perform a cutting operation of the paper P. In other words, at an entry of the cutter opening 34, the movable blade 37 is caused to slide toward the fixed blade 36. Then, the movable blade 37, which has been slid, is overlapped so as to ride on the fixed blade 36, to thereby cut the paper P while sandwiching between itself and the fixed blade 36. With this, the cut paper P may be used as a statement of account, or the like.

Further, the print unit 2 stops, when the cutting operation is ended, the operation of the roller portion 26 in the first guide path 20, and also stops the operations of the platen roller 30 and the thermal head 31. With this, the paper P pulled out from the main roll R1 becomes a waiting state again in the first guide path 20.

On the other hand, when the printing operation and the cutting operation of the paper P are ended together, the paper discharge unit 3 drives the motor to rotate the driving rollers 70, and the paper P waiting in the waiting path 43 is conveyed in the forward direction toward the discharge port 41. With this, as illustrated in FIG. 1 and FIG. 2, the paper P is discharged from the discharge port 41, and becomes a state in which a part thereof is projected from the eject port 4*a* of the enclosure 4. That is, the paper P becomes a receive-waiting state of waiting to be received by a user Here, if a given period time has elapsed without the discharged paper P being received by the user, the motor is operated so as to rotate in the direction which is reverse to the former direction, and rotates the driving rollers 70 constituting the conveyance mechanisms 45 in the reverse direction. With this, the conveyance mechanisms 45 reconvey the paper P toward the direction which is reverse to the former to be fed toward the merged portion 48. For that reason, the paper P is conveyed in the reverse direction within the waiting path 43 from the discharge port 41 toward the merged portion 48.

By the way, the paper P is caused to ride over the step portion at which the first base plate 53 and the second base plate 54 are overlapped in the midway toward the merged portion 48. In this case, basically, the paper P rides over the step portion without being caught, etc., because the paper P is conveyed through the driving rollers 70. However, if the paper P is bent between the driving rollers 70 so that the paper P may have contacts with the base plate 50, it is hard to cause the catch, etc. Specifically, at an overlapped portion 53*b* of the first base plate 53, the cutout portion 53*c* having a V-shape is formed toward the merged portion 48, and hence if the paper P is brought into contact with the step portion, it is hard to cause the catch, thereby being easily smoothly ridden over the step. Therefore, even if the step is provided in the midway, it is possible to reliably convey the paper P to the merged portion 48.

Then, the paper P arrived at the merged portion 48 is naturally led to the collection path 44 side by the leading strip 98 to be fed into the collection path 44. The paper P fed into the collection path 44 is conveyed downstream side by the driving roller 90 and the driven roller 91 constituting the input mechanism 46 to be thrown into the collection chamber 47.

With this, the paper, which was not received by the user P, may be collected to the collection chamber 47, thereby being capable of preventing the paper P to be exposed to others.

In particular, the input mechanism 46 conveys the paper P to the downstream side while sandwiching the paper P by the driving roller 90 and the driven roller 91 to throw the paper P into the collection chamber 47. However, in this case, as illustrated in FIG. 2, through the sandwiching by the both rollers 90 and 91, the folds M are forcedly formed across the total length of the paper P in the conveying direction. For that reason, even if the paper curling such as rounding in the conveying direction is imparted, it is possible to correct the imparted paper curling by the folds M forcedly formed, and vice versa it is possible to impart the paper P to keep a level state.

Therefore, the paper P collected within the collection chamber 47 becomes a shape, which is hard to be rounded and keeping a level state. For that reason, the collected paper P is not bulky, and hence a large amount of the paper P may be efficiently collect within the collection chamber.

Note that, at the worst, if the paper P, which is fed into the collection path 44, is kept being sandwiched between the driving roller 90 and the driven roller 91 without being thrown into the collection chamber 47, the paper P is never fed to the waiting path 43 side by mistake.

Specifically, if the next paper P is fed through the input port 40 from the print unit 2 and the motor is operated so that the paper P is fed into the waiting path 43, the driving roller 90 constituting the input mechanism 46 is adapted to rotate only in such a direction that the paper P is thrown into the collection chamber 47 by the one-way clutch. Therefore, if the motor is operated so that the paper P is fed from the input path 42 to the waiting path 43, the one-way clutch performs the idle rotation so that the driving roller of the input mechanism 46 does not rotate. Accordingly, even if the paper P is in a state being left within the collection path 44, the paper P may be prevented from being conveyed to the waiting path 43 side.

Further, as the waiting path 43 of the paper discharge unit 3 of this embodiment is formed so as to be curved across the interval between the merged portion 48 and the discharge port 41, while securing a sufficient path length, the linear length from the merged portion 48 to the discharge port 41 may be shortened. Therefore, while achieving downsizing and more compact size of overall size of the paper discharge unit 3, it is possible to secure the sufficient length of the waiting path 43. Accordingly, even if the paper P has a long print length, it is possible to cause the paper P to wait reliably until the printing operation and a cutting operation are ended within the waiting path 43.

Further, the waiting path 43 is formed into a curve so as to be swelled downward between the merged portion 48 and the discharge port 41, and hence when the paper which was not received by the user P is reconveyed from the discharge port 41 toward the merged portion 48, the paper P is conveyed such that the paper P is once dropped from the discharge port 41, and thereafter move upward as approaching to the merged portion 48. Then, the paper P, which has been moved upward, is guided as it is to the collection path 44, and thereafter thrown into the collection chamber 47. Therefore, the paper P may be thrown into the collection chamber 47 as if the paper P is fallen down from the above. Accordingly, the paper P may be efficiently thrown into the collection chamber 47, thereby being capable of enhancing the collection efficiency.

In addition, the paper P guided into the waiting path 43 waits within the waiting path 43 until the processings such as printing or cutting are ended. However, at this point of time, the paper P is free from entering into the collection path 44. Specifically, different from the conventional ones, the paper P in a waiting state is allowed to wait without being brought into contact with the collected paper. Therefore, the paper in a waiting state is prevented from being entangled with the collected paper, thereby being capable of suppressing occurrence of paper jam, or the like.

As described above, according to the paper discharge unit of this embodiment, while achieving downsizing of overall size of the paper discharge unit 3, it is possible to secure the sufficient length of the waiting path 43, and also the paper in a waiting state P is allowed to wait without being brought into contact with the collected paper until the processings such as printing are ended. Further, at the time of collection, the folds M are forcedly imparted on the paper P, and hence it is possible to collect the large amount of the paper P with efficiently.

In addition, according to the paper discharge unit 3 of this embodiment, the following operation effect may be attained.

First, the waiting path 43 is defined between the base plate 50 and the cover plate 51, and hence the paper P may be guided by the both plates 50 and 51. As a result, even if the waiting path 43 itself is curved, it is possible to smoothly convey the paper P in the forward direction or the reverse direction.

Further, the conveyance mechanisms 45 are brought into contact with each other between the base plate 50 and the cover plate 51, and includes the driving rollers 70 and the driven rollers 71 which may sandwich the paper P therebetween. Therefore, by such an easy method involving suitably rotating the driving rollers 70, it is possible to reliably convey the paper P along the waiting path 43 defined between the base plate 50 and the cover plate 51.

Moreover, the driven rollers 71 are brought into pressure connect with the driving rollers 70 by a plate spring 80, it is possible to more reliably convey the paper P while sandwiching therebetween.

Further, as for the second base plate 54 constituting the base plate 50, through the rotation of the second base plate 54 about the front shaft 56 as a center to obtain the opened state, as illustrated in FIG. 8, the waiting path 43 may be released. Therefore, even if the paper P is jammed within the waiting path 43 to cause the paper jam, it is possible to remove the paper P immediately to resolve the paper jam.

Further, as the leading strip 98 is formed at the merged portion 48, when the paper P which was not received by the user is reconveyed in the reverse direction to be guided into the collection path 44, the leading strip 98 guides the paper P toward a proper direction, and reliably guides the paper P to the collection path 44. For that reason, it is possible to prevent the paper P from being guided to the input path 42 side by mistake at the merged portion 48. Accordingly, it is possible to prevent in advance the occurrence of the paper jam, etc.

Further, the driven roller 91 constituting the input mechanism 46 has the annular projection 95 formed thereto, and the driving roller 90 has the annular groove 96 formed thereto. Accordingly, when the paper P is thrown into the collection chamber 47 while sandwiching the paper P with the driving roller 90 and the driven roller 91, the annular projection 95 is fitted into the annular groove 96 while pressing the paper P thereinto. With this, the paper P becomes a state of being pressed by the annular projection 95 and the annular groove 96, thereby being capable of imparting into shapes following those annular projection 95 and annular groove 96, namely, V-shape. Then, the paper P is conveyed in this state through the rotations of the both rollers 90 and 91, the above-mentioned V-shape may be imparted across the total length of the paper P along the conveying direction. Like this, it is possible to form the sufficiently imparted clear folds M on the paper P.

Moreover, the anti-slipping members 97 are attached to the driving roller 90 of this embodiment, and the annular groove 96 is formed between the anti-slipping members 97. Accordingly, when the annular projection 95 is fitted into the annular groove 96 while pressing the paper P thereinto, the paper P is not pressed into the annular groove 96 while being side-slipped, and a portion sandwiched by the antislipping members 97 is pulled and extended to be pressed thereinto. For that reason, it is possible to imparting a shape which is further similar to the annular projection 95 and the annular groove 96, thereby being capable of forming more clear folds M onto the paper.

In addition, as the driving roller 90 and the driven roller 91 are brought into pressure connect with each other by the plate spring 80, it is possible to sufficiently press the paper P by the annular projection 95 and the annular groove 96. In this point, too, it is easier to impart the clear folds M.

From the fact described above, it is possible to reliably correct the paper curling, and to correct the paper P with a shape which is hard to be rounded and is keeping the level state, thereby being capable of enhancing the efficiency of collecting the paper.

Note that, the collection chamber 47 of this embodiment, as illustrated in FIG. 10, the bottom plate portion 86 is adapted to be rotatable about the rotation shaft portion 87 as a center, thereby being in an opened state. As a result, the collected paper P can be disposed from the collection chamber 47.

It should be noted that the technical scope of the present invention is not limited to the above-mentioned embodiment, various modifications may be added within a range that does deviate from the gist of the present invention.

For example, in the above-mentioned embodiment, description is made of the printer 1 in which the print unit 2 and the paper discharge unit 3 are integrally assembled by way of example, but the paper discharge unit 3 may be constructed as a separate body from the print unit 2.

Further, in the above-mentioned embodiment, it is constructed so that the respective rollers 70 and 90 are rotated by a single motor. However, the motor may be provided so as to correspond to the respective rollers 70 and 90, and may be rotated independently.

Further, the driving rollers 70 constituting the conveyance mechanisms 45 may be provided on the cover plate 51 sided, and the driven rollers 71 may be provided-on the base plate 50 side. It should be noted that the driving rollers 70 are preferably provided on the base plate 50 side guiding the paper P.

Similarly, the driving roller 90 constituting the input mechanism 46 may be provided on the rear plate 61 side of the direction changing plate 52, and the driven roller 91 may be provided on the base plate 50. It should be note that even in this case, too, the driving roller 90 is preferably provided on the base plate 50 side guiding the paper P. Further, the annular groove 96 is formed on the driving roller 90 side, and the annular projection 95 is formed on the driven roller 91 side, vice versa, the annular projection 95 may be formed on the driving roller 90 side, and the annular groove 96 may be formed on the driven roller 91 side. Also in this case, the similar operation effects may be attained.

Further, in the above-mentioned embodiment, the annular projection 95 is formed into the V-shape, but is not limited to this shape. Alternative shapes include U-shape and the other shapes. Anyway, there is no problem as long as an annular projection is swelled outward of the radial direction. In this case, the annular groove 96 may be formed following the shape of the annular projection 95. Even in this case, it is possible to form the folds across the total length of the paper P in the conveying direction (for example, U-shape fold), and the paper curling may be corrected similarly.

What is claimed is:

1. A paper discharge device, comprising:

a waiting path, one side of which is connected to an input port and another side of which is connected to a discharge port;

a collection path, one side of which is connected to the waiting path through a merged portion and another side of which is connected to a collection chamber; and a plurality of conveyance mechanisms provided along the waiting path for conveying paper which was conveyed through the input port to the discharge port in a forward direction, and for conveying, after lapse of a given waiting period of time after the conveyance of the paper, the paper in a reverse direction through the merged portion to feed the paper into the collection path, wherein the waiting path is located between the merged portion and the discharge port and has a downward curvature in the interval between the merged portion and the discharge port.

2. A paper discharge device according to claim 1, wherein the plurality of conveyance mechanisms each comprises driving rollers which convey the paper in one of a forward direction and a reverse direction; and driven rollers which are driven in contact with the driving rollers, and are capable of sandwiching the paper between themselves and the driving rollers.

3. A paper discharge device according to claim 2, further comprising an urging member which urges the driven rollers toward the driving rollers side so that the both rollers are brought into pressure-contact with each other.

4. A paper discharge device according to claim 1, further comprising:

a base plate for guiding the paper; and a cover plate which is overlapped with respect to the base plate with a gap therebetween to thereby define a path between itself and the base plate, wherein at least a part of the base plate is made separable with respect to the cover plate so that the waiting path is releasable.

5. A paper discharge device according to claim 1, wherein a leading member is provided at the merged portion for leading the paper, which was conveyed in the reverse direction in the waiting path, toward the collection path side.

6. A paper discharge device according to claim 1, wherein the entire length of the waiting path is located between the merged portion and the discharge port.

7. A paper discharge device according to claim 1, wherein the waiting path is stationary during use of the paper discharge device.

8. A paper discharge device according to claim 1, wherein the waiting path is comprised of opposed spaced-apart plates.

9. A paper discharge device according to claim 1, wherein the collection path is comprised of opposed spaced-apart plates.

10. A paper discharge device according to claim 1, wherein the waiting path is inclined downward, for a major portion of its length, in a direction from the side thereof connected to the discharge port to the side thereof connected to the input port.

11. A paper discharge device according to claim 1, wherein the conveyance mechanisms are disposed in spaced-apart relation lengthwise along the waiting path.

* * * * *